United States Patent [19]

Sheehan et al.

[11] 4,397,140

[45] Aug. 9, 1983

[54] METHOD AND APPARATUS FOR SPLICING YARNS AND TOW

[75] Inventors: Richard W. Sheehan; Willys D. Burnett, both of Johnson City, Tenn.

[73] Assignee: Sherwood Research Corporation, Johnson City, Tenn.

[21] Appl. No.: 300,650

[22] Filed: Sep. 9, 1981

[51] Int. Cl.[3] ..... B65H 69/06; D02J 1/08

[52] U.S. Cl. ..... 57/22; 28/274

[58] Field of Search ..... 57/22, 23, 202, 350; 28/271–276

[56] References Cited

U.S. PATENT DOCUMENTS

| | | | |
|---|---|---|---|
| 3,274,764 | 9/1966 | Gonsalves | 57/202 |
| 3,306,020 | 2/1967 | Rosenstein | 57/22 |
| 3,339,362 | 9/1967 | Dodson, Jr. et al. | 57/22 |
| 3,474,615 | 10/1969 | Irwin et al. | 57/22 X |
| 3,581,486 | 6/1971 | Dibble | 57/22 |
| 3,643,417 | 2/1972 | Irwin | 57/202 |

*Primary Examiner*—John Petrakes

*Attorney, Agent, or Firm*—Luedeka & Neely

[57] ABSTRACT

A method and apparatus for interentangling ends of multi-filament yarn and tow which involves subjecting the overlapped ends to jets of gaseous fluid to interentangle the ends. The method involves employing a plurality of jets, one of which tends to rotate at least one of the filaments, and the other of which tends to move the filaments transversely. The jets act on the filaments when they are in motion from a previous jet. The apparatus provides a chamber for containing the overlapped ends and for defining the jets.

8 Claims, 7 Drawing Figures

METHOD AND APPARATUS FOR SPLICING YARNS AND TOW

The present invention relates generally to a method and apparatus for splicing textile yarns or tow comprising a number of filaments and more particularly to a method and apparatus employing air jets for entangling the filaments or threads to provide an improved splice.

In the past, overlapped ends of multi-filament yarns have been spliced by passing them through a chamber which is provided with a jet of air or the like which is adapted to entangle the filaments or threads so as to connect the two ends together. These devices have been in use for a considerable period of time and typical units of this type are shown in U.S. Pat. Nos. 3,274,764; 3,306,020; 3,339,362; 3,474,615; 3,581,486 and 3,643,417. These devices provide splices but it has been found, in operation, that the strength and permanence of the splice is less than desired. Basically, the prior splicers either employ a jet which is directed at right angles to the path of movement of the yarns being spliced, or are provided with a jet which provides a swirling action of tangential air currents which are directed around the periphery of the yarn.

As pointed out above, such splicing devices do not provide an entirely satisfactory splice with yarn and are not effective to splice tow or multi-filament yarns which are of a high total denier.

Accordingly, it is the object of this invention to provide an improved method and apparatus for producing an improved splice in multi-filament yarns or spun yarns. It is also an object of the invention to provide a method and apparatus for splicing tow or other high total denier bundles of filaments. Other objects and advantages of the invention will become known by reference to the following description and the accompanying drawings in which:

FIG. 5 is an end view of splicing device for tow or the like;

It has been found that the strength and integrity of a splice of overlapped multi-filament yarns may be enhanced if the filaments or threads are entangled by moving them through a passageway where they are subjected to a combination of generally tangential as well as generally perpendicular jets of gaseous fluid, in effecting the splice. The use of jets which are directed perpendicularly to and tangential to the line of movement of the overlapped ends causes the filaments to be subjected to forces in one direction which cause movement in that direction and, simultaneously or thereafter, while the filaments are being moved by the first jet they are subjected to forces of the second jet which cause them to move in another direction. Such application of force causes the filaments to be entangled in a random pattern which results in a stronger and more permanent splice than is obtained by the use of air jets which apply forces in only one direction.

Satisfactory results are obtained when the two forces are applied simultaneously to the yarn or tow but, for best results, it is preferred that the first force is applied at one point along the longitudinal line of movement of the yarn as it passes through the splicer before it is subjected to the second force which moves the filaments in another direction. Also, it is preferred that the forces provide alternate tangential rotation of the filaments and generally perpendicular movement. The order of movement is not to be critical but it is important that the movement caused by the first jet is still effective at the time the filaments are subjected to the force of the adjacent jet.

In general, the apparatus comprises means which define a generally cylindrical passageway through which overlapped yarn or tow ends can be moved under substantially no tension and with substantially no overfeed, the passageway being provided with one or more orifices which direct a gaseous fluid jet generally perpendicularly against the yarn or tow and a second jet or jets which are effective to cause rotative movement of the filaments.

Figure 2:
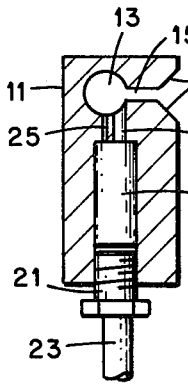
FIG. 2 is an end view, partially in section, taken along line 2—2 in FIG. 1.
Figure 1:
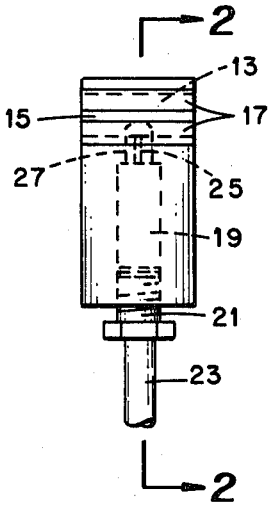
FIG. 1 is an elevational view of a splicing device embodying various of the features of the invention.

Now referring to the drawings, FIGS. 1 and 2 illustrate a splicing device which is particularly adapted for splicing two single ends of multi-filament yarns in total denier ranges of from about 100 to about 2850 as well as spun yarns in the range of 60/1 cotton count to #2's cotton count. As illustrated, the device includes a block 11 of metal or the like which is provided with a cylindrical passageway 13 which runs from one side of the block 11 to the other. In order to insert the overlapped yarn ends into the device for splicing, there is provided a slot 15 which is parallel to the axis of the cylindrical passageway 13. In order to facilitate the entrance of the yarn ends into the cylindrical passageway 13 the outer end of the slot 15 is beveled, as indicated at 17—17.

An air chamber 19 is provided in the block 11 which the air chamber 19 is connected by means of a threaded connection 21, and hose 23 to a source of pressurized fluid, not shown. In order to provide one jet, an orifice 25 is drilled between the end of the air chamber 19 (adjacent the passageway 13) and the wall of the passageway 13, the orifice 25 being arranged at right angles to the longitudinal axis of the cylindrical passageway 13 which is parallel to the path of the yarn ends being spliced. A second orifice 27 is also provided between the air chamber 19 and the cylindrical passageway 13. The orientation of the orifice 27 is such that it directs air from the chamber 19 tangentially around the cylindrical passageway 13. As illustrated, the orifices 25 and 27 lie in a plane which is at right angles to the axis of the passageway 13.

In operation, the yarn ends which are to be spliced are overlapped and drawn through the passageway 13 generally along its axis. The jet of air or other gaseous fluid emanating from the orifice 25 applies forces to the filaments in the overlapped yarn ends to cause them to move transversely of the cylindrical passageway 13. At the same time, the jet of air or other gaseous fluid emanating from the orifice 27, causes the filaments in the overlapped yarn ends to rotate about the axis of the passageway 13. Using this combination of forces, it has been found that an extremely strong and permanent splice is obtained between the two overlapped yarn ends.

In one embodiment of the device for splicing single ends of filament yarns in total denier ranges of 100 to 2850, and spun yarns in the range of 60/1 cotton count to #2's cotton count, the yarn passageway 13 has ranged from a diameter of about 0.250 to about 0.500 inches. The orifice 25 has a diameter of approximately 0.075 inches and the orifice 27 has a diameter of approximately 0.125 inches. The device employs air at a pressure of from approximately 20 to 100 lbs./sq. in., depending upon the material being entangled.

Figure 4:
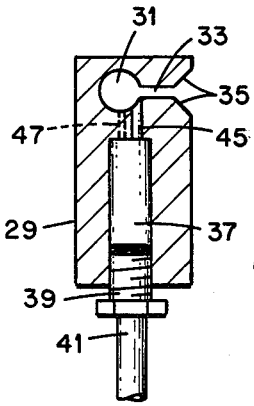
FIG. 4 is an end view, partially in section, taken on line 4—4 in FIG. 3.
Figure 3:
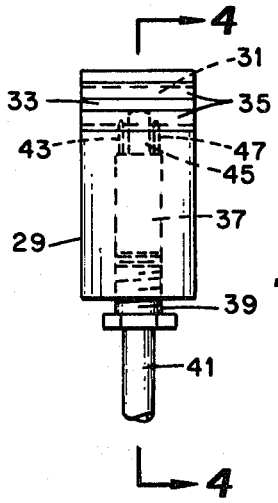
FIG. 3 is an elevational view of a splicing device having a preferred configuration of air jets.

FIGS. 3 and 4 illustrate a preferred splicing device for two single ends of multi-filament yarns in total denier ranges from about 100 to about 2850 as well as spun yarns in the range of 60/1 cotton count to #2's cotton count. The device is made in substantially the same way as the device illustrated in FIGS. 1 and 2 and includes a block 29 of metal or the like which is provided with a cylindrical passageway 31 which runs from one side of the block 29 to the other. In order to insert the overlapped yarn ends into the device for splicing, there is provided a slot 33 which is parallel to the axis of the cylindrical passageway 31. Again, to facilitate the entrance of the yarn ends into the cylindrical passageway 31, the outer end of the slot 33 is beveled, as indicated at 35—35.

An air chamber 37 in the block 29 is connected by means of a threaded connection 39 and a hose 41 to a source of pressurized fluid, not shown. In order to provide the entanglement, three orifices are provided which are longitudinally spaced along the line of movement of the yarn in the passageway 31. The first orifice 43 is drilled between the end of the chamber 19 (adjacent the passageway 13) and the wall of the passageway 31, the orifice 43 being arranged at right angles to the central axis of the cylindrical passageway 31. A second orifice 45 is also provided between the air chamber 37 and the cylindrical passageway 31. The orientation of the orifice 45 is such that the air from the chamber 19 is directed tangentially around the cylindrical passageway 31. A third orifice 47 is provided between the air chamber 37 and the cylindrical passageway 31. The orientation of the orifice 47 is arranged at right angles to the axis of the center of the cylindrical passageway 31. As has been pointed out, the orifices 43, 45 and 47 are spaced apart along the line of movement of the yarns being spliced.

In operation, the yarn ends which are to be spliced are overlapped and drawn through the passageway 31, generally along its axis with no substantial tension or overfeed. The jet of air or other gaseous fluid emanating from the orifice 43 applies forces to the filaments in the overlapped yarn ends to cause them to move transversely of the cylindrical passageway 31. Subsequently, while still under the influence of the jet from the orifice 43, the yarn ends move to a point where they are subjected to the jet emanating from the orifice 47 which causes the filaments and the overlapped yarn ends to rotate about the axis of the passageway 31. Subsequently, as the yarn ends move through the passaeway 31 they are subjected to the jet emanating from the orifice 47 which again causes the filaments to move transversely of the passageway 31.

The configuration which has been described provides a preferred splice between the two overlapped yarn ends which approaches or even exceeds the strength of the yarn ends themselves.

Successful results have been obtained in splicing single ends of filaments in total denier ranges of from 100 to 2850, and spun ranges of 60/1 cotton count to #2's cotton count with a yarn passageway 31 which has a diameter from about 0.250 to about 0.500 inches. The orifices 43 and 47 have a diameter of approximately 0.075 inches and the orifice 45 has a diameter of approximately 0.125 inches. The device employed air at a pressure from approximately 20 to 100 lbs./sq. in., depending upon the material being entangled.

Figure 5:
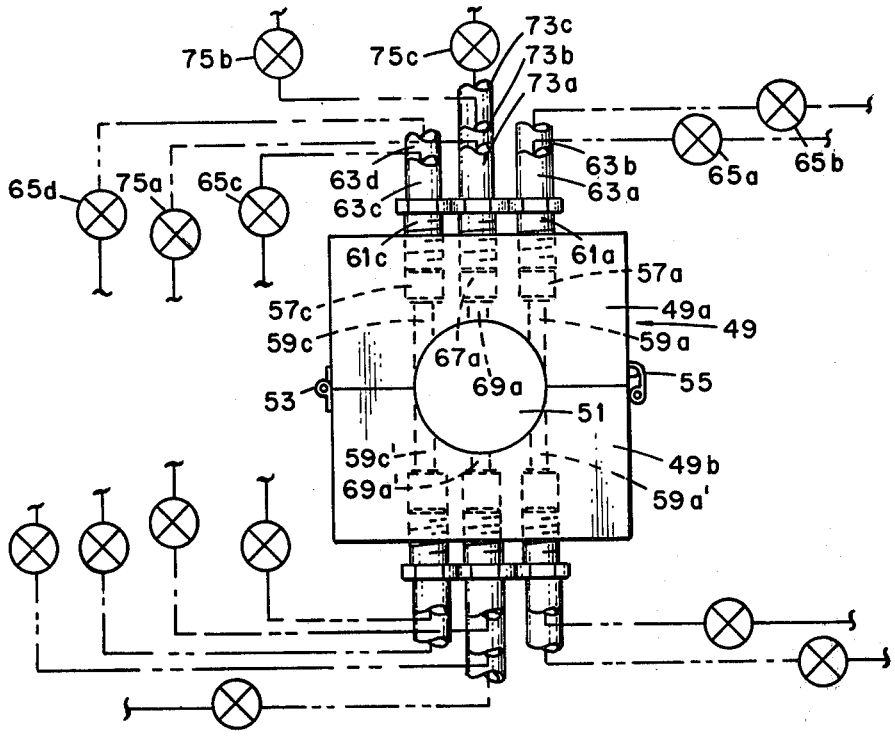
Figure 6:
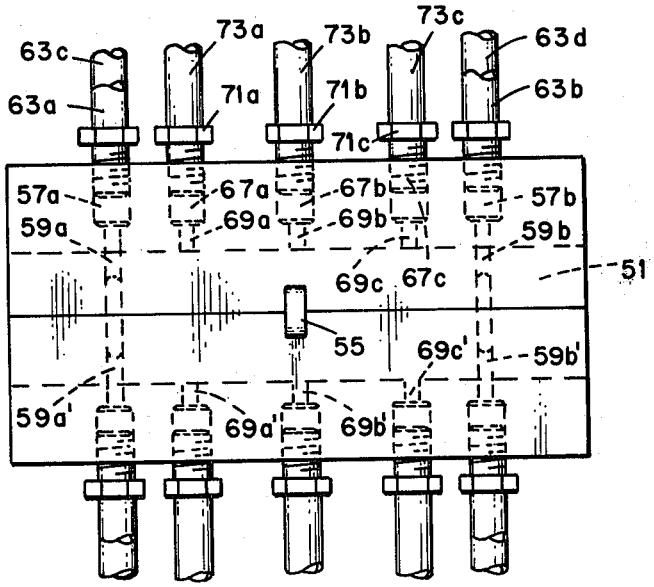
FIG. 6 is an elevational view of the device illustrated in FIG. 5.
Figure 7:
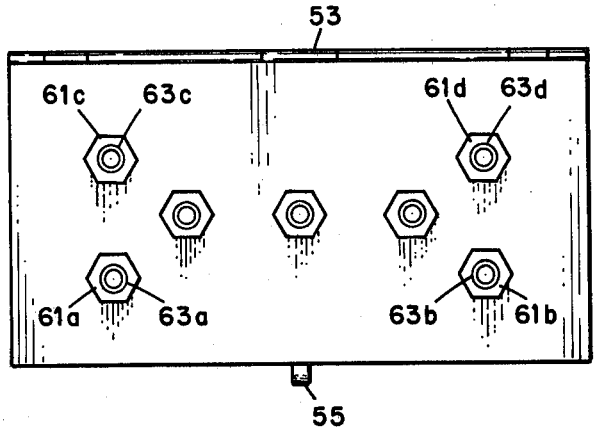
FIG. 7 is a top view of the device shown in FIG. 5.

In FIGS. 5, 6 and 7, there is illustrated a tow splicer which is operable to splice two ends of tow materials in the range of from about 100,000 to about 500,000 total denier. Heretofore it has been substantially impossible to splice tow of this weight.

The illustrated device comprises a block of metal or the like 49, which is machined to provide a generally cylindrical passageway 51 through which the overlapped tow ends can be passed. In order that the tow can be inserted in the passageway 51, the block 49 is cut to provide two sections **49*a* and 49*b*, the cut bisecting the passageway 51. In order to provide for inserting the tow, the two sections 49*a* and 49*b* are hinged at one side by the hinge assembly 53, and at the other side a latch 55** is provided to lock the two sections together.

Each of the sections **49*a* and 49*b* is provided with a plurality of air chambers and orifices which provide jets which provide forces to either move the filaments in the tow in a transverse direction relative to the line of movement of the tow (the axis of passageway 51) or to rotate the filaments around the axis of the passageway. Since both of sections 49*a* and 49*b* are identical, only the construction of section 49*a* will be described in detail. In the section 49*a* of the block 49 there is provided a plurality of air chambers 57*a–d*. Each of these chambers is connected by an orifice 59*a–d*, respectively, to the central passageway 51. The orifices 59*a–d* are tangentially oriented relative to the wall of the passageway 51 so as to provide rotational movement of fluid around the wall of the passageway 51. As illustrated, orifices 59*a* and 59*c* are positioned at opposite sides of the passageway 51 adjacent one of its ends and orifices 59*b* and 59*d* are positioned at opposite sides of the passageway 51. Each of the air chambers 57*a–d* are connected by means of couplings 61*a–d*, respectively, hoses 63*a–d*, respectively, and valves 65*a–d***, respectively, to sources of pressurized fluid such as compressed air.

In addition to the air chambers **57*a–d* , and their associated tangential orifices, section 49*a* is provided with air chambers 67*a–c*, which are aligned and spaced apart along the axis of the passageway 51. Each of the chambers 67*a–c* is connected to the passageway 51 by means of orifices 69*a–c*, respectively, which are oriented to provide a jet of gaseous fluid directed perpendicularly to the longitudinal axis of passageway 51, which provides a perpendicularly directed force against the tow in the passageway 51. The chambers 67*a–c* are connected by means of couplings 71*a–c*, respectively, hoses 73*a–c*, respectively, and valves 75*a–c***, respectively, to sources of pressurized fluid such as compressed air.

As illustrated in the drawings, FIGS. 4 and 5, similar mating orifices, air chambers, couplings, hoses and valves are provided in the lower section **49*b* of the block 49. In order to avoid unnecessary duplication it can be stated the mating units are substantially identical to their opposed units in section 49*a***. For the purpose of further description only the orifices are numbered on the drawings each given the designation of its corresponding orifice with the addition of a prime (') symbol.

Thus, it will be seen that it is possible to subject tow ends in the passageway 51 to a number of combinations of air currents to assure efficient entanglement of filaments which make up the tow.

Nylon tow having a total denier of approximately 420,000 was spliced by overlapping two ends approximately 4 feet. The overlapped ends were drawn through the passageway 51 which was 1.25 inches in diameter. All of the orifices were 0.25 inches in diameter. All of the valves 65 and 75 were closed except the valves for orifices 59*a'*, 69*a* and 69*b*. This provided one upwardly directed tangential jet and two downwardly directed perpendicular jets. Air pressure to the tangential orifice 59*a'* was approximately 75 psig and the pressure to orifices 69*a* and 69*b* was approximately 150 psig. The two ends were drawn through the splicer under substantially no tension and an adequate splice was obtained by passing the four foot overlapped section through the device in about thirty seconds. The orifices provided in the block 49 make possible various combinations of rotative and transverse forces which can be used to splice various materials. Rayon, acrylic, and other fibers all require different conditions for splicing as do tows made up of monofilaments of different sizes. With the splicer which has been described all of these may be spliced employing the principle that the tow filaments should be moved in one direction by an air jet and thereafter be moved in another direction by a subsequent jet or jets. By using the device shown in the drawing, it is possible to employ a number of combinations which provide rotative air currents as well as transverse air currents which will effect substantial entangling of adjacent filaments to provide a strong and permanent splice.

Various of the features of the invention which are believed to be new are set forth in the appended claims.

What is claimed is:

1. A splicing device for splicing overlapped multifilament yarn and tow comprising means defining a generally cylindrical passageway having open ends and dimensioned to contain overlapped ends of the yarn or tow and through which overlapped ends may be passed, a first orifice in the wall of said passageway for directing a jet of gaseous fluid perpendicular to the axix of said passageway and into the approximate center of the yarn or tow so that the filaments of the yarn or tow are subjected to forces which cause some of them to move transversely in said passageway, and a second orifice in the wall of said passageway for directing a jet of gaseous fluid tangentially around said cylindrical passageway and generally tangentially to the surface of the yarn or tow so that filaments of the yarn or tow are subjected to forces which cause at least some of the filaments to rotate about the axis of said passageway.

2. The device of claim 1 wherein said first and second orifices are spaced longitudinally apart along the axis of said passageway.

3. The device of claim 2 wherein a third orifice is provided in the wall of said passageway for directing a jet of gaseous fluid against said ends, said third orifice being spaced longitudinally along the line of movement of said yarn ends from said first and second orifices and said orifices providing alternate tangential and perpendicular forces to said filaments as the ends are moved through said chamber.

4. The device of claim 3 wherein the orifices are arranged to provide in order, perpendicular, tangential and perpendicular forces of said filaments.

5. The device of claim 1 wherein the first and second orifices are connected to a common source of gaseous fluid and the second orifice is of larger diameter than said first orifice.

6. The device of claim 1 wherein there is provided a plurality of each of said first and second orifices each of which is connected to a source of pressurized gaseous fluid, valve means between said source of pressurized fluid and each orifice whereby selected orifices may be employed to generate said transverse and rotative forces.

7. The method of interentangling ends of multi-filmament yarn and tow which comprises the steps of overlapping the ends to be interentangled, passing the interentangled ends through a chamber, while in said chamber subjecting said ends to a plurality of jets of gaseous fluid at least one of which produces forces which tend to rotate at least some of the filaments relative to the line of movement of said ends and at least one of which produces forces which tend to move at least some of the filaments transversely relative to the line of movement of said ends, said jets causing said filaments when in motion from one jet to be moved in a different direction by another jet.

8. The method of claim 7 wherein the jets producing rotative forces are of a lower velocity than the jets providing transverse forces.

* * * * *